US009157217B2

(12) United States Patent
Vannitamby et al.

(10) Patent No.: US 9,157,217 B2
(45) Date of Patent: Oct. 13, 2015

(54) TOOL RETENTION SYSTEM HAVING CAM-DRIVEN KEYS

(71) Applicant: Caterpillar Inc., Peoria, IL (US)

(72) Inventors: Shevon Anthony Vannitamby, Peoria, IL (US); Terry Ray Lamprecht, Bartonville, IL (US); Ryan Christopher Sommer, Sparland, IL (US); Mitchell Meyer Porembski, Moline, IL (US)

(73) Assignee: Caterpillar Inc., Peoria, IL (US)

( * ) Notice: Subject to any disclaimer, the term of this patent is extended or adjusted under 35 U.S.C. 154(b) by 142 days.

(21) Appl. No.: 13/948,836

(22) Filed: Jul. 23, 2013

(65) Prior Publication Data

US 2015/0027009 A1 Jan. 29, 2015

(51) Int. Cl.
*E02F 9/28* (2006.01)

(52) U.S. Cl.
CPC ..... *E02F 9/2833* (2013.01)

(58) Field of Classification Search
CPC ..... E02F 9/2833; E02F 9/2841; E02F 9/2816; E02F 9/2825; E02F 9/2891
USPC ..... 37/456
See application file for complete search history.

(56) References Cited

U.S. PATENT DOCUMENTS

| | | | | | |
|---|---|---|---|---|---|
| 3,341,253 | A * | 9/1967 | Hostetter | 299/10 |
| 3,997,989 | A * | 12/1976 | Stepe | 37/457 |
| 4,067,657 | A * | 1/1978 | Kaarlela | 403/317 |
| 4,918,843 | A * | 4/1990 | Kiesewetter et al. | 37/457 |
| 5,765,301 | A * | 6/1998 | Clendenning | 37/457 |
| 5,868,518 | A * | 2/1999 | Chesterfield et al. | 403/379.4 |
| 6,108,950 | A * | 8/2000 | Ruvang et al. | 37/452 |
| 6,757,995 | B2 | 7/2004 | Pippins | |
| 7,121,023 | B2 | 10/2006 | Robinson et al. | |
| RE41,855 | E * | 10/2010 | Ruvang et al. | 37/456 |
| 2003/0070330 | A1 * | 4/2003 | Olds et al. | 37/456 |
| 2003/0101627 | A1 * | 6/2003 | Robinson et al. | 37/456 |
| 2004/0016153 | A1 * | 1/2004 | Pippins | 37/456 |
| 2004/0216336 | A1 * | 11/2004 | Briscoe | 37/455 |
| 2005/0028407 | A1 * | 2/2005 | Ruvang et al. | 37/456 |
| 2007/0137072 | A1 * | 6/2007 | Briscoe | 37/453 |
| 2008/0028644 | A1 * | 2/2008 | Lopez Almendros et al. | 37/457 |
| 2010/0115804 | A1 * | 5/2010 | Lopez Almendros et al. | 37/456 |
| 2010/0162595 | A1 * | 7/2010 | Leslie et al. | 37/456 |

(Continued)

FOREIGN PATENT DOCUMENTS

WO WO 2011/134014 11/2011

*Primary Examiner* — Robert Pezzuto
*Assistant Examiner* — Jessica H Lutz
(74) *Attorney, Agent, or Firm* — Finnegan, Henderson, Farabow, Garrett & Dunner, LLP

(57) ABSTRACT

A retention system is provided for use in connecting a replaceable tool to a work implement. The retention system may have a sleeve configured to be received within corresponding bores in the work implement and the replaceable tool. The sleeve may have a radially oriented hole passing through an outer surface thereof. The retention system may also have a pin disposed within the sleeve. The pin may have a cam lobe located at an end adjacent the radially oriented hole of the sleeve and radially offset from a central axis. The retention system may additionally have a key disposed within the radially oriented hole of the sleeve and configured to ride on the cam lobe. The key may be movable during rotation of the pin from a retracted position to an activated position at which the key extends beyond the outer surface of the sleeve.

19 Claims, 5 Drawing Sheets

(56) References Cited

U.S. PATENT DOCUMENTS

| | | | | |
|---|---|---|---|---|
| 2010/0170119 | A1 | 7/2010 | Lopez Almendros et al. | |
| 2010/0229433 | A1* | 9/2010 | Leslie et al. | 37/456 |
| 2012/0055052 | A1* | 3/2012 | Campomanes et al. | 37/456 |
| 2012/0260540 | A1 | 10/2012 | Guimaraes et al. | |
| 2013/0269223 | A1* | 10/2013 | Knight | 37/456 |
| 2014/0013635 | A1* | 1/2014 | Cui | 37/456 |
| 2014/0082977 | A1* | 3/2014 | Pilon | 37/453 |
| 2014/0298692 | A1* | 10/2014 | Marchand | 37/444 |

* cited by examiner

TOOL RETENTION SYSTEM HAVING CAM-DRIVEN KEYS

TECHNICAL FIELD

The present disclosure relates generally to a tool retention system and, more particularly, to a tool retention system having cam-driven keys.

BACKGROUND

Earth-working machines, such as cable shovels, excavators, wheel loaders, and front shovels, include implements generally used for digging into, ripping, or otherwise moving earthen material. These implements are subjected to extreme abrasion and impacts that causes them to wear. To prolong the useful life of the implements, various ground engaging tools can be connected to the earth-working implements at areas experiencing the most wear. These ground engaging tools are replaceably connected to the implements using a retention system.

An exemplary system for retaining a ground engaging tool connected to an implement is disclosed in U.S. Pat. No. 4,067,657 of Kaarlela that issued on Jan. 10, 1978 ("the '657 patent"). Specifically, the '657 patent discloses a cam lock retaining means for a ripper. The cam lock retaining means includes a cylindrical pin that passes through corresponding bores in a ripper shank and a ripper tip. Spaced apart keys are reciprocally mounted within an outer annular surface of the pin, and set screws are threadingly disposed within opposing axial ends of the pin. As torque is applied to the set screws, the set screws are driven axially into the pin to engage ends of the associated keys and urge them radially outward into bearing contact with the ripper tip, thereby securing the tip to the shank.

Although acceptable for some applications, the retaining means of the '657 patent may be less than optimal. In particular, over time, the components of the shank, tip, and retaining means can wear, resulting in loosening of the joint. Although additional tensioning of the set screws may retighten this engagement, eventually enough wear may occur such that additional tensioning is not possible. When this occurs, the retaining means must be replaced. This replacement can be time consuming and costly. In addition, loosening of the joint may give false impressions to a machine operator regarding durability of the retaining means. Further, because the keys of the '657 patent are separately extended to contact the ripper tip, it may be possible for the cylindrical pin to be cocked within a bore of the ripper shank. This could lead to premature loosening or damage of the joint.

The disclosed tool retention system is directed to overcoming one or more of the problems set forth above.

SUMMARY

According to one exemplary aspect, the present disclosure is directed to a retention system for use in connecting a replaceable tool to a work implement. The retention system may include a sleeve configured to be received within corresponding bores in the work implement and the replaceable tool. The sleeve may have a radially oriented hole passing through an outer surface thereof. The retention system may also include a pin disposed within the sleeve. The pin may have a cam lobe located at an end adjacent the radially oriented hole of the sleeve and radially offset from a central axis. The retention system may additionally include a key disposed within the radially oriented hole of the sleeve and configured to ride on the cam lobe. The key may be movable during rotation of the pin from a retracted position to an activated position at which the key extends radially beyond the outer surface of the sleeve.

According to another exemplary aspect, the present disclosure is directed to a method of securing a replaceable tool to a work implement. The method may include moving the replaceable tool over a portion of the work implement to generally align corresponding bores in the replaceable tool and the work implement, and placing a sleeve of a retention system into the corresponding bores. The method may also include rotating a pin within the sleeve to cause a cam lobe to push a key radially outward through a hole in the sleeve and engage the replaceable tool.

DETAILED DESCRIPTION

Figure 1:
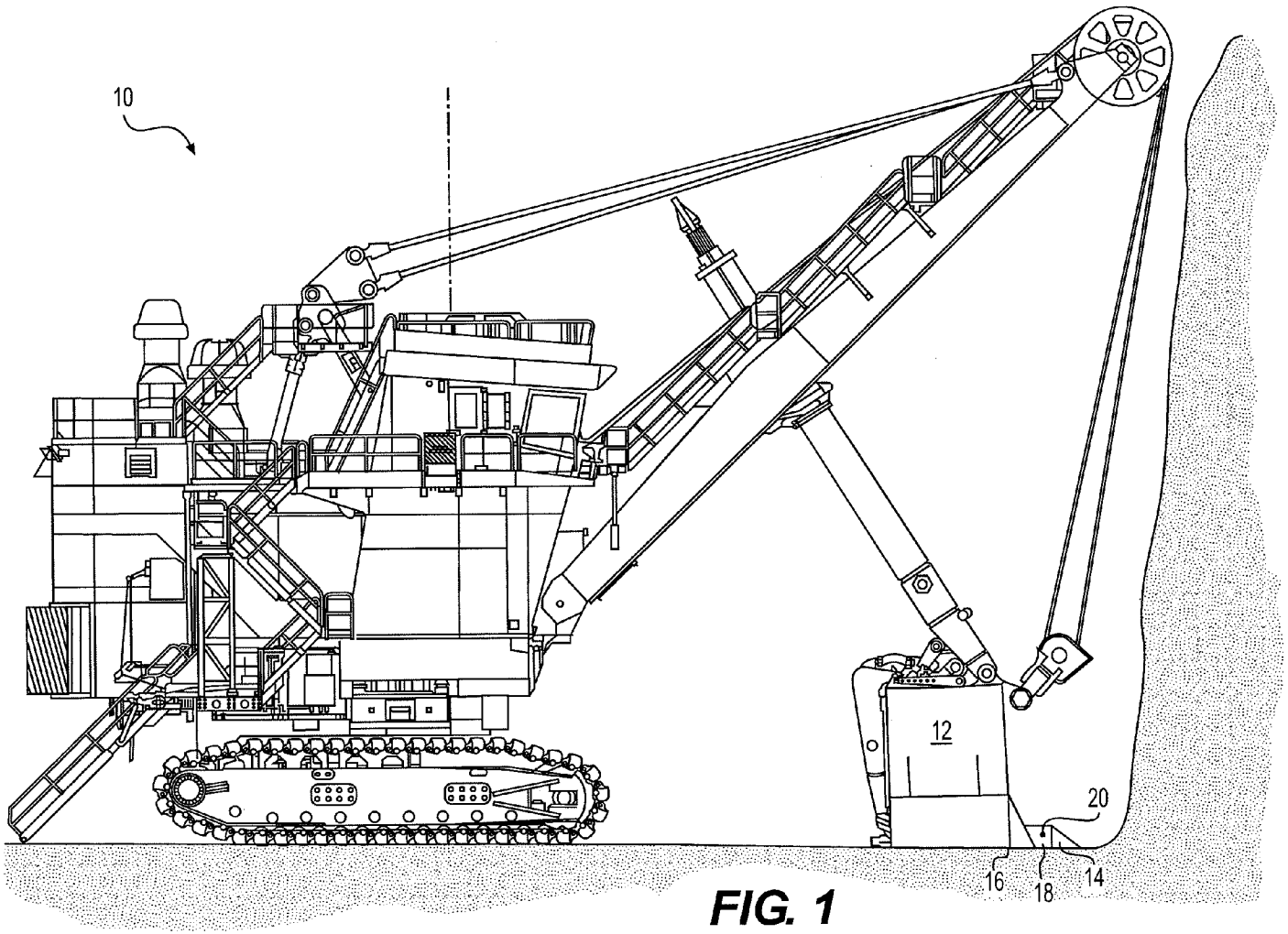
FIG. 1 is a side-view illustration of an exemplary disclosed machine.

FIG. 1 illustrates a mobile machine 10 having a work implement 12 operatively connected at a leading end. In the disclosed embodiment, machine 10 is a rope shovel. It is contemplated, however, that machine 10 may embody any other type of mobile or stationary machine known in the art, for example a wheel loader, an excavator, a motor grader, a dredge, or another similar machine. Machine 10 may be configured to use work implement 12 to move material, such as earthen overburden and ore, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform a particular task. For example, work implement 12 could be a bucket (shown in FIG. 1), a blade, a shovel, a crusher, a grapple, a ripper, or any other material moving device known in the art. In addition, although connected in the embodiment of FIG. 1 to lift, curl, and dump relative to machine 10, work implement 12 may alternatively or additionally rotate, swing, pivot, slide, extend, open/close, or move in another manner known in the art.

Work implement 12 may be equipped with one or more ground engaging tools (GET) 14 located at a cutting edge 16. For example, the disclosed bucket could be provided with multiple similar tooth assemblies that are spaced apart along a length of cutting edge 16. While shown as single-point, sharpened tooth assemblies, it is contemplated that GET 14 could take any other form known in the art, for example a fork (i.e., multi-point) configuration, a chisel configuration, or a blunt-end configuration.

Figure 2:
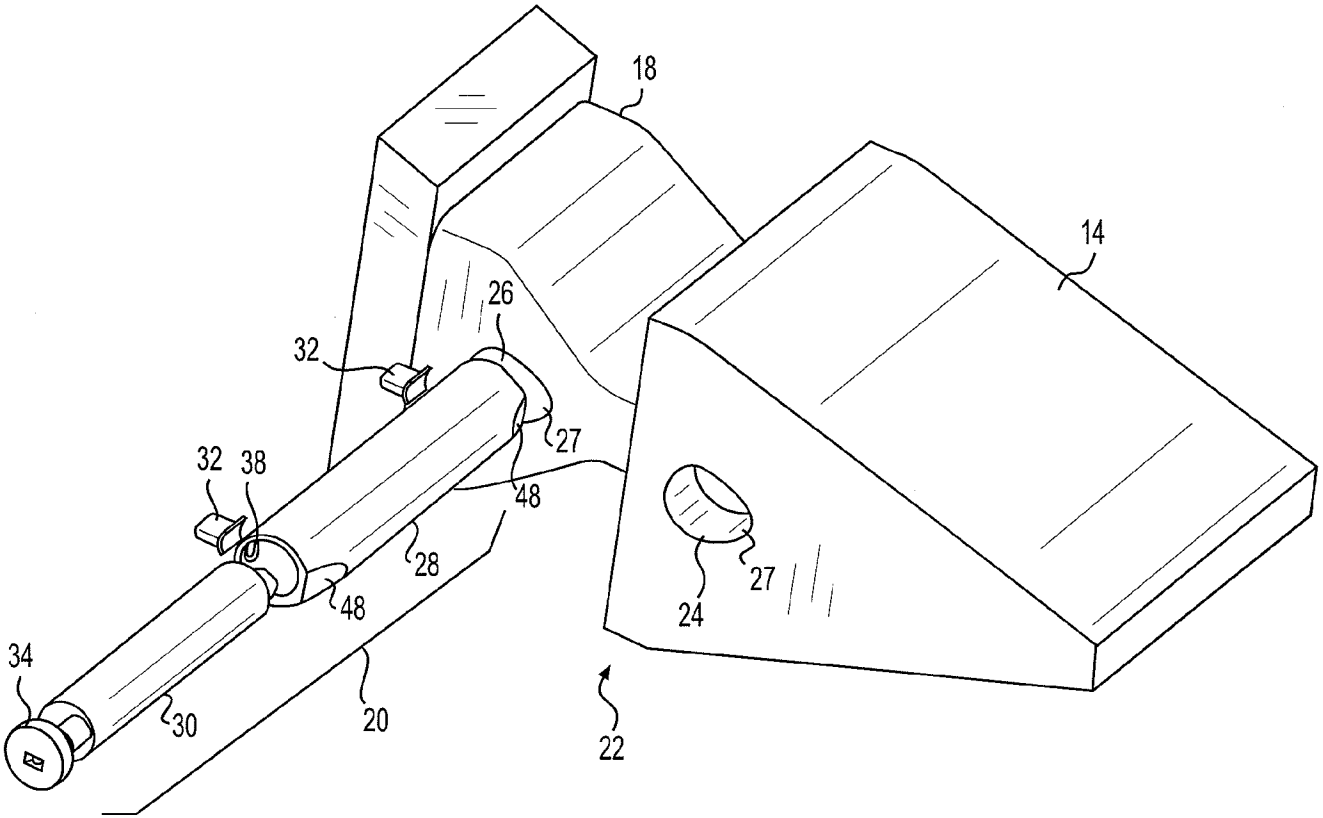
FIG. 2 is an exploded view illustration of an exemplary disclosed tool retention system that may be used in conjunction with the machine of FIG. 1.

GET 14 may be a conventional single- or multi-piece component that is removably connected to work implement 12. In the embodiment shown in FIGS. 2 and 3, GET 14 is a single-piece component that is connected to a mounting nose 18 of work implement 12 at cutting edge 16 via a retention system 20. Mounting nose 18 may be joined to cutting edge 16 in any manner known in the art, for example via welding, threaded fastening, integral posts and clips, etc. Thereafter, retention system 20 may be used to removably connect GET 14 to work implement 12.

GET 14 and mounting nose 18 may both be generally hollow structural members, and a base end 22 of GET 14 may be configured to fit over mounting nose 18. A pair of aligned bores 24 (only one shown in FIG. 2) may be formed at base end 22 of GET 14 within opposing side walls thereof, and a corresponding bore 26 may be formed within mounting nose 18. Bores 24 may be generally aligned with bore 26 when GET 14 is placed over mounting nose 18, so as to create an aligned space that receives retention system 20. Bores 24, 26 may each include an anti-rotation feature 27 that inhibits rotation of retention system 20 once installed into the aligned space. In the disclosed embodiment, anti-rotation feature 27 is an asymmetric opening (e.g., an asymmetric triangular or elliptical opening) that allows insertion of retention system 20 in only a single orientation.

Retention system 20 may include components that interact to clamp GET 14 in a removable manner to mounting nose 18. Specifically, retention system 20 may include, among other things, a sleeve 28, a pin 30, two keys 32, and a cap 34. As will be described in more detail below, sleeve 28 may be insertable into aligned bores 24, 26; pin 30 may be slidably received within sleeve 28; keys 32 may be located at spaced apart ends of sleeve 28; and cap 34 may close off an end of sleeve 28 so as to retain pin 30 and keys 32 within sleeve 28.

Figure 3:
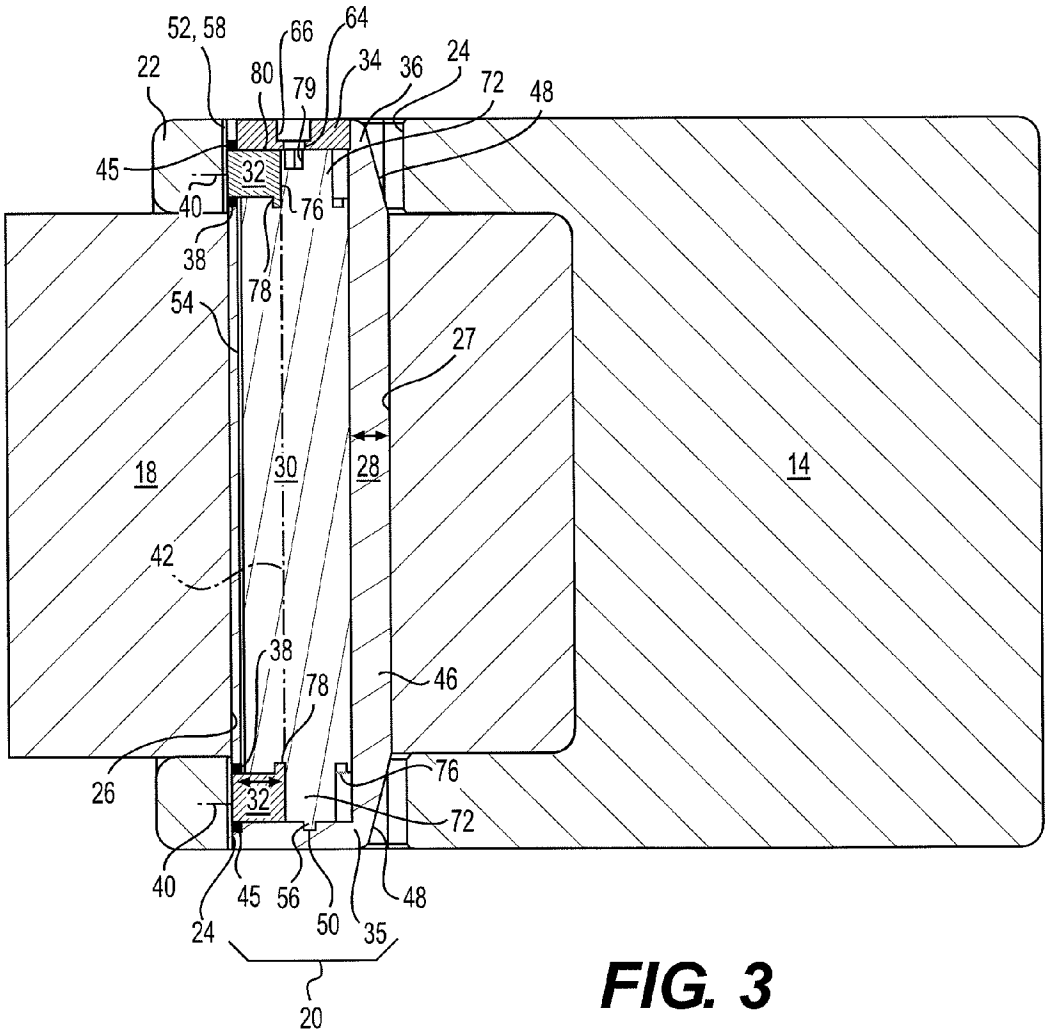
FIG. 3 is a cross-sectional illustration of the tool retention system of FIG. 2.
Figure 4:
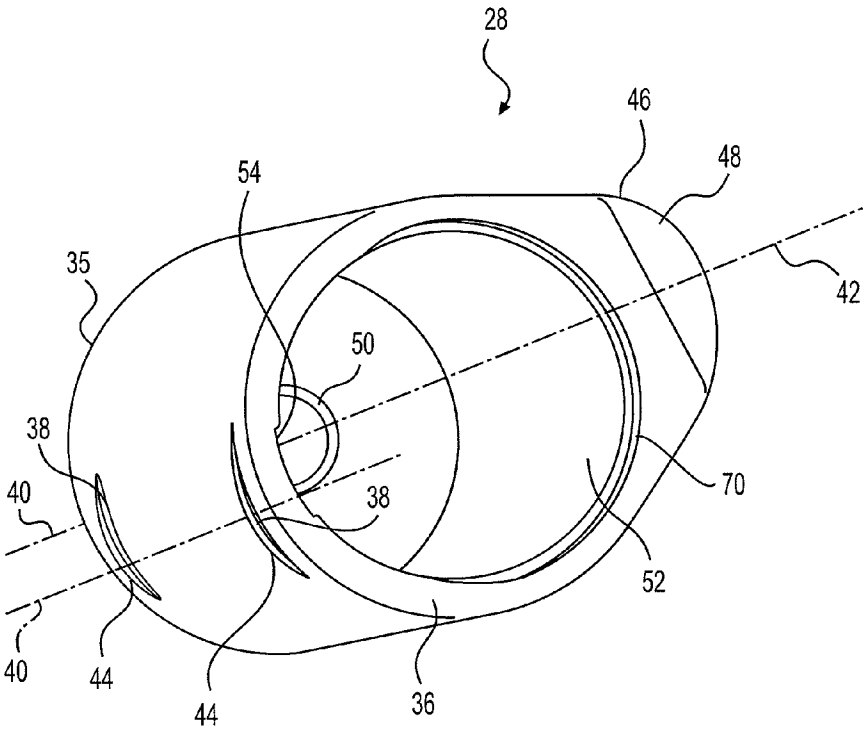

As shown in FIGS. 3 and 4, sleeve 28 may be a generally hollow cylindrical component having a closed end 35 and an open end 36. A radially-oriented hole 38 may be formed at each opposing end of sleeve 28 within an outer surface thereof and configured to slidingly receive a corresponding key 32. Each hole 38 may be generally circular or elliptical, and have an axis 40 that extends inward to intersect with a central axis 42 of sleeve 28 at about a 90° angle. Axes 40 of holes 38 may be generally parallel with each other. An annular recess 44 may be formed at each hole 38 and configured to receive a corresponding seal 45 (e.g., an o-ring seal—shown only in FIG. 3), which encircles key 32 and seals off an internal space of sleeve 28.

Sleeve 28 may include an anti-rotation feature 46 configured to engage anti-rotation feature 27 described above. In the disclosed embodiment, anti-rotation feature 46 is a radial protrusion located at one side of sleeve 28, such that a cross-section of sleeve 28 has an asymmetric triangular or elliptical shape. This protrusion may extend axially along a majority length of sleeve 28 and be located at the side of sleeve 28 opposite holes 38. In the disclosed embodiment, anti-rotation feature 46 is oriented forward toward GET 14 and away from mounting nose 18 once fully assembled, although other configurations may also be possible. A bevel 48 may be formed at each end of anti-rotation feature 46 to facilitate assembly into bores 24, 26 when bores 24, 26 are not completely aligned.

Sleeve 28 may include additional features configured to interact with other components of retention system 20. For example, sleeve 28 may include a bearing recess 50 located at closed end 35, threads 52 located at open end 36, and a radial keyway 54 that extends axially between open and closed ends 35, 36. Bearing recess 50 may be configured to receive a corresponding bearing post 56 of pin 30 and thereby support rotation of pin 30. Threads 52 may be configured to engage corresponding threads 58 of cap 34. Radial keyway 54 may be configured to provide clearance for keys 32 that is required during assembly, and to help retain keys 32 in radial alignment with holes 38. Radial keyway 54 may also create a space around each key 32 that is configured to collect and store debris that enters sleeve 28 via holes 38 (e.g., debris that has adhered to keys 32 before retraction through holes 38 into sleeve 28).

Figure 5:
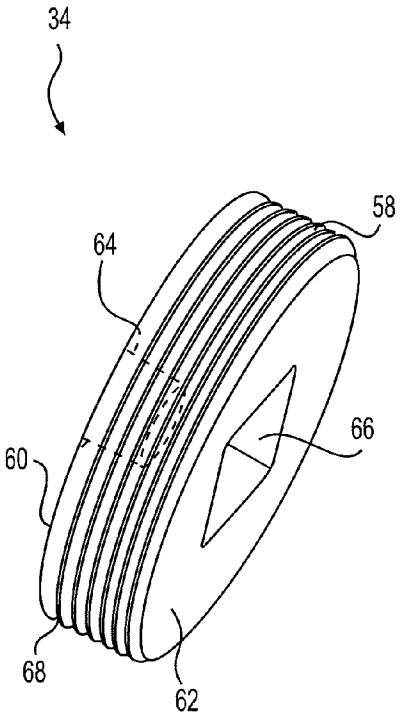
FIGS. 4-7 are isometric view illustrations of exemplary disclosed components of the tool retention system of FIGS. 2 and 3.

As shown in FIG. 5, cap 34 may include an inner surface 60, an outer surface 62, and threads 58 that extend in an axial direction between inner and outer surfaces 60, 62. A bearing recess 64 may be formed at inner surface 60 and configured to support a bearing post 56 at an end opposite bearing recess 50 within sleeve 28. A tool engagement feature 66 (e.g., a hexagonal or square shaped recess) may be formed at outer surface 62 for use in installing cap 34. Bearing recess 64 may be accessible from outer surface 62 (e.g., via tool engagement feature 66), such that a tool may be inserted into or around an end of pin 30 and used to apply torque to pin 30 that causes it to rotate. An annular recess 68 may be formed at an axial end of threads 58 near inner surface 60. Annular recess 68 may be configured to receive a seal (e.g., an o-ring seal—not shown) that engages a shoulder 70 at open end 36 of sleeve 28 (referring to FIG. 4) to seal off the internal space of sleeve 28.

Figure 6:
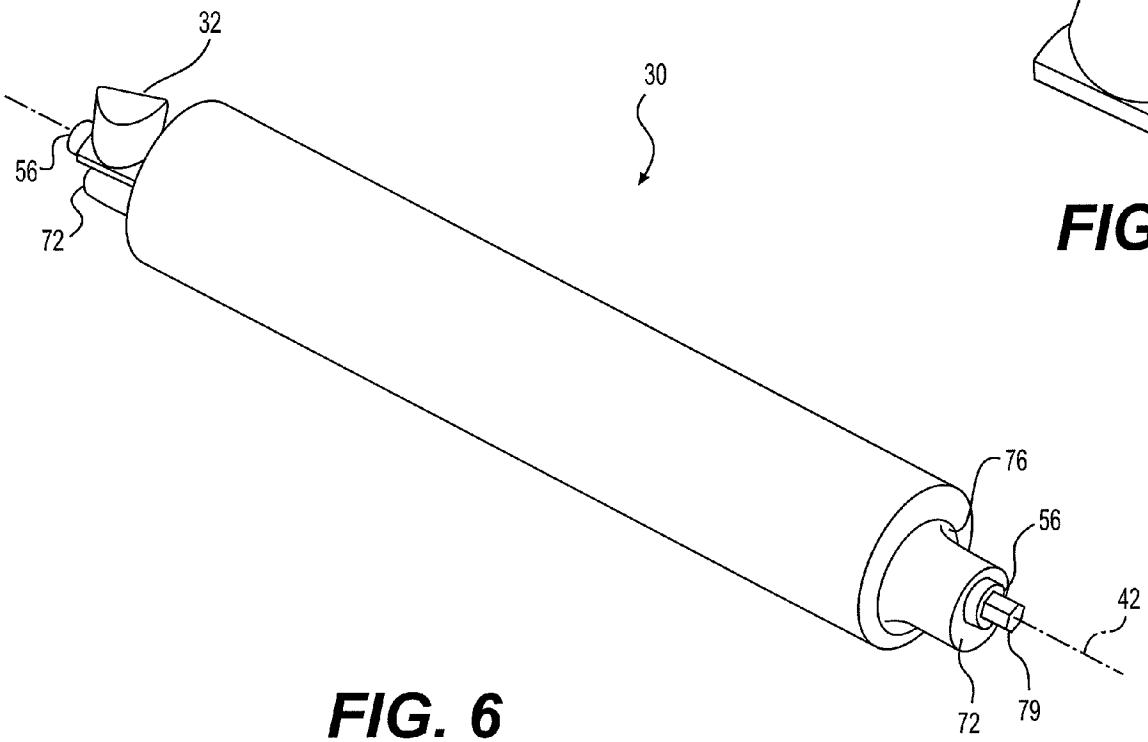

As shown in FIGS. 3 and 6, pin 30 may be generally cylindrical and include at each end a cam lobe 72, from which bearing posts 56 protrude. Cam lobes 72 may be located generally adjacent holes 38 when retention system 20 is fully assembled. Cam lobes 72 may be cylindrical protrusions that are offset from center axis 42, such that as pin 30 rotates in a first direction, keys 32 riding along an outer cylindrical surface of cam lobes 72 extend radially outward relative to axis 42 to an activated position. An annular track 76 may be recessed within axial ends of pin 30, around cam lobes 72, and configured to receive an arcuate ledge 78 (referring to FIG. 7) of a corresponding key 32. That is, ledge 78 may ride inside of track 76 and track 76 may function to draw key 32 radially back inward to a retracted position as pin 30 is rotated in a second direction opposite the first.

Pin 30 may include a tool engaging feature 79 located at a cap end (i.e., at the end associated with cap 34). Tool engaging feature 79 may be accessible while cap 34 is connected to sleeve 28. In the disclosed example of FIG. 6, tool engaging feature 79 is configured to protrude outward from bearing post 56 through cap 34. In another example shown in FIG. 3, tool engaging feature 79 is a square or hexagonal recess formed within bearing post 56 and visible through the openings of cap 34. In either configuration, after cap 34 has been loosened, a tool (not shown) may be connected with tool engaging feature 79 and used to rotate pin 30, thereby extending or retracting keys 32. After extension of keys 32, cap 34 may be tightened against the cap end of pin 30, thereby inhibiting additional rotation in either direction.

Figure 7:
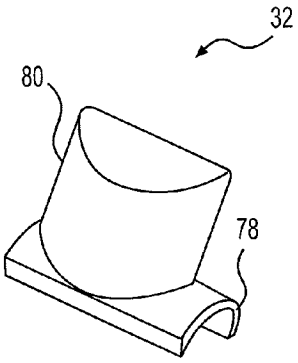

As shown in FIGS. 3 and 7, key 32 may include a generally cylindrical or elliptical protrusion 80 that extends radially outward at one end of ledge 78. An inner surface of ledge 78 may be curved to match an outer profile of cam lobe 72, while an outer end surface of protrusion 80 may be curved to match an inner profile of radial keyway 54. In the disclosed embodiment, a height of key 32 may be about equal to ½ of an axial length of ledge 78. This arrangement may help to reduce binding of key 32 within radial keyway 54 during assembly.

As shown in the cross-section of FIG. 3, the rotation of pin 30 within sleeve 28 may result in simultaneous reciprocating movements of both keys 32 from the retracted position toward the activated position. Specifically, as pin 30 is rotated, cam lobe 72 may also rotate from a first position at which a peak or area of greatest radius is away from keys 32, toward a second position at which the peak is against ledges 78 of keys 32. When the peak is against keys 32, keys 32 may be forced rearward (e.g., to the left in FIG. 3) to push against base end 22 of GET 14. When keys 32 push against GET 14, a reactionary force may be created that pushes pin 30 and sleeve 28 forward against the tip end of mounting nose 18. These motions may result in movement of GET 14 into greater engagement with mounting nose 18 and a tightening of the associated joint. In contrast, when the peak of cam lobe 72 is away from keys 32, keys 32 may be drawn forward (e.g., to the right in FIG. 3) and away from base end 22 of GET 14 by the engagement of ledge 78 with track 76. When keys 32 are pulled away from GET 14, a reactionary force may be created pulling pin 30 and sleeve 28 rearward away from the tip end of mounting nose 18. These motions may result in loosening of the associated joint.

Pin 30 may only be rotated when cap 34 is loosened. That is, cap 34, in addition to sealing off an end of sleeve 28 may also function to selectively inhibit rotation of pin 30. As can be seen in FIG. 3, cap 34 may be configured to engage an end of pin 30 when fully assembled, thereby locking pin 30 to sleeve 28 through friction. Accordingly, pin 30 may only be rotated when cap 34 has been loosened to sufficiently reduce this friction. It should be noted that cap 34 may not need to be completely removed to allow pin 30 to be rotated. That is, cap 34 may be loosened, pin 30 rotated to tighten the connection of GET 14 to mounting nose 18, and then cap 34 re-tightened to inhibit reverse rotation of pin 30. This ability may help reduce a time required to service GET 14.

Industrial Applicability

The disclosed tool retention system may be applicable to various earth-working machines, such as cable shovels, wheel loaders, excavators, front shovels, dredges, and bulldozers. When used to removably connect ground engaging tools to the work implements of these machines, the ground engaging tools may be maintained in tight connection with the work implements throughout operation. Accordingly, the disclosed tool retention system may help to prolong the useful life of the implements and the machines, while also helping the operator to remain confident in the durability of the ground engaging tool. Use of tool retention system 20 to improve connection of GET 14 to work implement 12 will now be described in detail.

Connection of GET 14 to work implement 12 may begin by moving base end 22 over a tip portion of mounting nose 18 to generally align bores 24 with bore 26. After these bores are generally aligned, retention system 20 (including sleeve 28, pin 30, keys 32, and cap 34 having been already assembled with keys 32 in their retracted positions) may be placed into the bores. Thereafter, a tool may be connected to tool engagement feature 66 of pin 30 via cap 34, and pin 30 may be rotated in a first direction within sleeve 28. As described above, this rotation may cause the peaks of cam lobes 72 to simultaneously push both keys 32 radially outward through holes 38 in sleeve 28 and engage base end 22 of GET 14. Once a sufficient degree of engagement between GET 14 and mounting nose 18 has been achieved, cap 34 may be tightened to engage the corresponding end of pin 30 and inhibit further rotation thereof. Rotation of pin 30 in the opposing direction (after loosening of cap 34) may result in retraction of keys 32 back through holes 38 into sleeve 28.

Because both keys 32 may be simultaneously extended, use and reliability of retention system 20 may be improved. That is, the service technician may need to only complete a single action to cause extension of both keys 32, which may help to reduce effort and time expended during the service. In addition, because both keys 32 may be extended at the same times and in the same amounts, the likelihood of sleeve 28 and pin 30 becoming cocked within bores 24, 26 may be low. Accordingly, the joint tightened with retention system 20 may have high reliability. Further, as keys 32 wear, they be separately replaceable, thereby reducing a servicing cost of retention system 20.

It will be apparent to those skilled in the art that various modifications and variations can be made to the disclosed retention systems. Other embodiments will be apparent to those skilled in the art from consideration of the specification and practice of the disclosed retention systems. It is intended that the specification and examples be considered as exemplary only, with a true scope being indicated by the following claims and their equivalents.

What is claimed is:

1. A retention system for use in connecting a replaceable tool to a work implement, the retention system comprising:

a sleeve configured to be received within corresponding bores in the work implement and the replaceable tool, the sleeve having a radially oriented hole passing through an outer surface thereof;

a pin disposed within the sleeve and having a cam lobe located at an end adjacent the radially oriented hole of the sleeve and radially offset from a central axis; and a key disposed within the radially oriented hole of the sleeve, the key including:

a curved inner surface configured to mate against a cylindrical outer surface of the cam lobe; and a curved outer surface configured to mate against a cylindrical inner surface of the sleeve, and configured to ride on the cam lobe, the key being radially movable during rotation of the pin from a retracted position to an activated position at which the key extends radially beyond the outer surface of the sleeve.

2. The retention system of claim 1, wherein the key is drawn into the sleeve by rotation of the pin.

3. The retention system of claim 2, wherein the key includes:

a ledge extending in an axial direction into a recessed track surrounding the cam lobe; and a generally cylindrical protrusion extending from one end of the ledge, wherein a height of the protrusion is about one-half of a length of the ledge.

4. The retention system of claim 1, wherein the sleeve includes a radial keyway extending in an axial direction at one side of the pin, the radial keyway configured to receive the key when the key is retracted during assembly of the pin.

5. The retention system of claim 1, further including a seal disposed around the key and configured to engage the sleeve.

6. The retention system of claim 1, wherein:

the sleeve includes an open end and a closed end; and the retention system further includes a cap configured to close off the open end and selectively inhibit rotation of the pin.

7. The retention system of claim 6, wherein the cap includes an opening configured to provide tool access to an end of the pin.

8. The retention system of claim 7, wherein the pin includes a protrusion extending through the opening of the cap.

9. The retention system of claim 7, further including a seal disposed between the cap and the sleeve.

10. The retention system of claim 6, wherein:

the sleeve includes a first end and a second end, and a first bearing recess formed within the second end and configured to receive a first bearing post of the pin; and the cap includes a second bearing recess configured to receive a second bearing post of the pin.

11. The retention system of claim 1, wherein the sleeve is generally cylindrical and includes an external anti-rotation feature configured to engage corresponding features in the replaceable tool and work implement to inhibit rotation of the sleeve.

12. The retention system of claim 11, wherein opposing ends of the sleeve are beveled at one side to facilitate insertion into the corresponding bores in the work implement and the replaceable tool.

13. The retention system of claim 1, wherein a debris collection space exists around the key inside the sleeve.

14. The retention system of claim 1, wherein:

the radially oriented hole is a first radially oriented hole located at a first end of the sleeve;

the cam lobe is a first cam lobe located at a first end of the pin;

the key is a first key disposed within the first radially oriented hole and configured to ride on the first cam lobe;

the retention system further includes a second key substantially identical to the first key, disposed within a second radially oriented hole located at a second end of the sleeve, and configured to ride on a second cam lobe located at a second end of the pin; and rotation of the pin results in simultaneous movement of the first and second keys between the retracted and activated positions.

15. A retention system for use in connecting a replaceable tool to a work implement, the retention system comprising:

a generally cylindrical sleeve configured to be received within corresponding bores in the work implement and the replaceable tool, the generally cylindrical sleeve having radially oriented holes passing through an outer surface thereof at opposing ends and an anti-rotation feature inhibiting rotation of the generally cylindrical sleeve;

a pin disposed within the generally cylindrical sleeve and having first and second cam lobes located at opposing ends adjacent the radially oriented holes of the generally cylindrical sleeve and radially offset from a central axis;

first and second keys disposed within the radially oriented holes of the generally cylindrical sleeve and configured to ride on the first and second cam lobes, each of the first and the second keys including:

curved inner surfaces configured to mate against cylindrical outer surfaces of the respective cam lobes; and curved outer surfaces configured to mate against a cylindrical inner surface of the sleeve, the first and second keys being radially movable during rotation of the pin from a retracted position to an activated position at which the first and keys engage the replaceable tool;

first and second seals disposed around the first and second keys and configured to engage the generally cylindrical sleeve; and a cap configured to close off an open end of the generally cylindrical sleeve and selectively inhibit rotation of the pin.

16. A method of securing a replaceable tool to a work implement, the method comprising:

moving the replaceable tool over a portion of the work implement to generally align corresponding bores in the replaceable tool and the work implement;

placing a sleeve of a retention system into the corresponding bores; and placing a key such that a curved inner surface of the key mates against a cylindrical outer surface of a cam lobe and a curved outer surface of the key mates against a cylindrical inner surface of the sleeve; and rotating a pin within the sleeve to cause the cam lobe to push the key radially outward through a hole in the sleeve and engage the replaceable tool.

17. The method of claim 16, wherein rotating the pin causes two cam lobes to simultaneously push keys located at opposing ends of the pin into engagement with the replaceable tool.

18. The method of claim 17, further including engaging a cap with an end of the sleeve to selectively inhibit rotation of the pin.

19. The method of claim 17, wherein:

rotating the pin includes rotating the pin in a first direction to extend the keys from the sleeve; and the method further includes rotating the pin in a second direction to retract the keys back into the sleeve.

* * * * *